US010511116B2

(12) United States Patent
Maesoba et al.

(10) Patent No.: US 10,511,116 B2
(45) Date of Patent: Dec. 17, 2019

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP); Kimiyasu Okumura, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/066,332

(22) PCT Filed: Jan. 13, 2017

(86) PCT No.: PCT/JP2017/001018
§ 371 (c)(1),
(2) Date: Jun. 27, 2018

(87) PCT Pub. No.: WO2017/122779
PCT Pub. Date: Jul. 20, 2017

(65) Prior Publication Data

US 2019/0006785 A1 Jan. 3, 2019

(30) Foreign Application Priority Data

Jan. 13, 2016 (JP) ..... 2016-004317

(51) Int. Cl.
*H01R 13/502* (2006.01)
*H01R 13/658* (2011.01)
(Continued)

(52) U.S. Cl.
CPC ..... *H01R 13/5025* (2013.01); *H01R 13/4364* (2013.01); *H01R 13/502* (2013.01);
(Continued)

(58) Field of Classification Search
CPC ..... H01R 13/658; H01R 13/6592; H01R 13/6593; H01R 9/0518; H01R 9/032;
(Continued)

(56) References Cited

U.S. PATENT DOCUMENTS 5,518,241 A * 5/1996 McHale ..... A63B 53/04 473/349
5,683,269 A * 11/1997 Davis ..... H01R 13/582 439/607.5
(Continued)

FOREIGN PATENT DOCUMENTS

JP 2002-319456 10/2002
JP 2003-173850 6/2003
(Continued)

OTHER PUBLICATIONS

International Search Report dated Mar. 28, 2017.

*Primary Examiner* — Gary F Paumen
(74) *Attorney, Agent, or Firm* — Gerald E. Hespos; Micheal J. Porco; Matthew T. Hespos

(57) ABSTRACT

It is aimed to reliably hold a terminal fitting in a dielectric while realizing miniaturization. A connector includes terminal fittings (20) connected to cores (16) of a shielded cable (15), a dielectric (23) made of synthetic resin and capable of accommodating the terminal fittings (20) in a positioned state, and an upper case (24) and a lower case (34) constituting a dielectric (23) by being united to sandwich the terminal fittings (20). The upper case (24) and the lower case (34) are united and divided in a direction intersecting an
(Continued)

arrangement direction of the terminal fittings (20) and the cores (16) connected to the terminal fittings (20).

9 Claims, 13 Drawing Sheets

(51) Int. Cl.
*H01R 13/436* (2006.01)
*H01R 13/639* (2006.01)
*H01R 13/6581* (2011.01)

(52) U.S. Cl.
CPC ..... *H01R 13/639* (2013.01); *H01R 13/658* (2013.01); *H01R 13/6581* (2013.01)

(58) Field of Classification Search
CPC .. H01R 24/40; H01R 13/5025; H01R 13/502; H01R 13/4364; H01R 13/639; H01R 13/6581
USPC ..... 439/585, 607.47–607.51
See application file for complete search history.

(56) References Cited

U.S. PATENT DOCUMENTS 5,725,395 A * 3/1998 Lee ..... H01R 13/504 439/108
5,941,733 A * 8/1999 Lai ..... H01R 13/6581 439/607.01
6,165,016 A 12/2000 Lai
6,599,151 B2 * 7/2003 Chiran ..... H01R 13/506 439/607.48
6,783,397 B2 * 8/2004 Yang Lee ..... H01R 13/504 439/607.41
6,821,151 B2 * 11/2004 Lai ..... H01R 9/032 439/607.51
7,367,841 B1 * 5/2008 Lin ..... H01R 13/6581 439/607.01
7,922,536 B2 * 4/2011 Zhang ..... H01R 13/6583 439/607.45
8,777,665 B2 * 7/2014 Il ..... H01R 13/6593 439/607.27
2007/0141890 A1 6/2007 Koyama
2013/0023155 A1 1/2013 Il

FOREIGN PATENT DOCUMENTS

JP 2007-172940 7/2007
JP 2013-25957 2/2013

* cited by examiner

CONNECTOR

BACKGROUND

Field of the Invention

The invention relates to a connector.

Description of Related Art

Japanese Unexamined Patent Publication No. 2002-319456 discloses a shield connector configured such that a terminal fitting connected to a core of a shielded cable is accommodated in a dielectric made of synthetic resin and an outer conductor having a shielding function is mounted on the outer periphery of the dielectric to constitute an end module, and the end module is inserted in a housing made of synthetic resin. A plate-like resilient locking piece is formed on an outer surface of the terminal fitting by being cut obliquely. The resilient locking piece is locked to a receiving portion on an inner surface of the dielectric to hold the terminal fitting in the dielectric.

If the shield connector described above is miniaturized, the terminal fitting also must be miniaturized. However, the resilient locking piece also becomes smaller and thinner if the terminal fitting is miniaturized. Thus, a locking force of the resilient locking piece decreases, and the terminal fitting may be separated from the dielectric. As a measure against this, a locking lance may be formed in the dielectric and the terminal fitting may be locked and retained by this locking lance. However, this approach enlarges the dielectric and therefore is not consistent with a goal to miniaturize the shield connector.

The invention was completed on the basis of the above situation and aims to reliably hold a terminal fitting in a dielectric while realizing miniaturization.

SUMMARY

The invention is directed to a connector with a terminal fitting to be connected to a core of a cable. The connector also has a dielectric made of synthetic resin and capable of accommodating the terminal fitting in a positioned state. The dielectric has two half bodies that are united to sandwich the terminal fitting. The half bodies are united and divided in a direction intersecting an arrangement direction of the terminal fitting and the core connected to the terminal fitting.

The terminal fitting is positioned in the dielectric by being sandwiched between the half bodies. Thus, it is not necessary to form a locking lance in the dielectric. Accordingly, the terminal fitting can be held reliably in the dielectric while miniaturizing the connector.

The invention may include a metal member. Additionally, positioning locking portions may be formed on the half bodies and may be configured to position the half bodies in a united state by being locked to the metal member. According to this configuration, the half bodies are not locked directly to each other but are positioned and held together via the metal member. The half bodies need not be formed with resiliently deflectable locking parts, thereby facilitating efforts to achieve miniaturization of the dielectric.

The metal member may include a first shell and a second shell. The first shell may be assembled with the first half body to cover an outer surface of the first half body in a state where the half bodies are divided, and the second shell may be assembled with the second half body to cover an outer surface of the second half body in the state where the half bodies are divided. The first shell may be formed with a uniting first locking portion, and the second shell may be formed with a uniting second locking portion. The first shell and the second shell may be held together to constitute the metal member by locking the uniting first locking portion and the uniting second locking portion to each other. According to this configuration, if the first half body and the first shell are assembled and the second half body and the second shell are assembled, the half bodies can be held together and the terminal fitting can be accommodated in the dielectric by uniting the two shells. Thus, when the half bodies are united while sandwiching the terminal fitting, a worker need not hold the half bodies together by hand.

The metal member may include a crimping portion to be crimped to an outer periphery of the cable. According to this configuration, relative displacements of the terminal fitting and the dielectric with respect to the cable are restricted if the crimping portion is crimped to the outer periphery of the cable. Thus, there is no risk of bending or deforming an exposed part of the core.

The cable may include a shield layer configured to electromagnetically shield the core by surrounding the core, and the metal member may be an outer conductor surrounding the dielectric while being connected to the shield layer.

DETAILED DESCRIPTION

Figure 1:
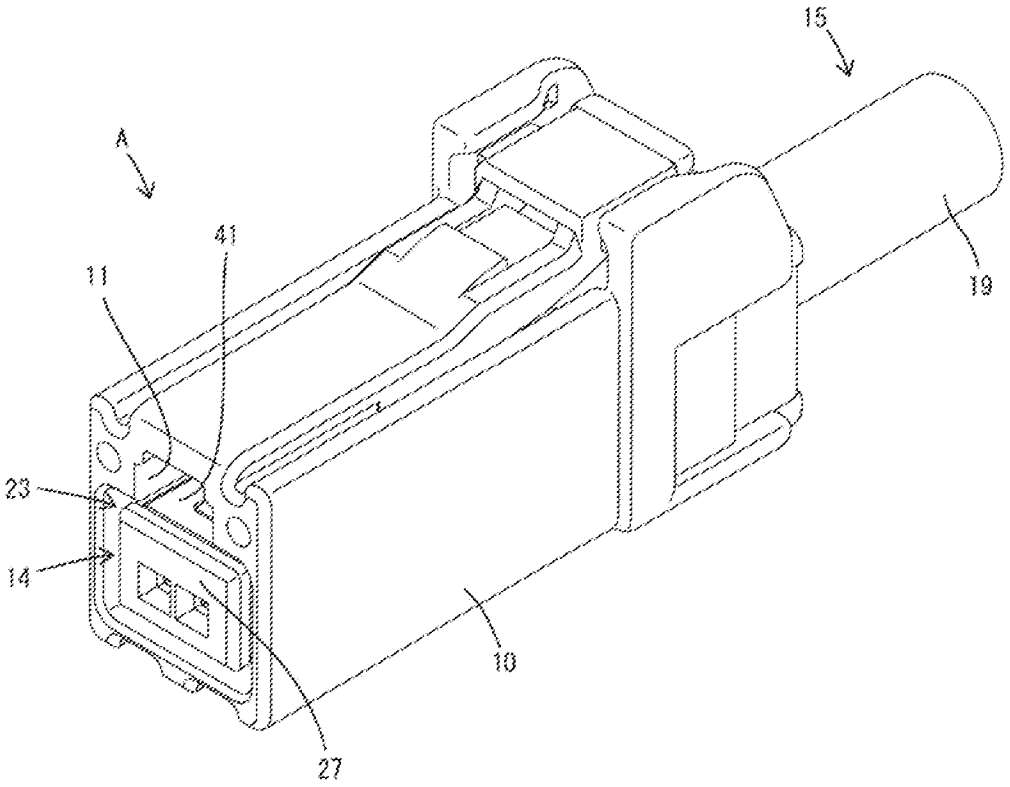
FIG. 1 is a perspective view of a shield connector of one embodiment.
Figure 2:
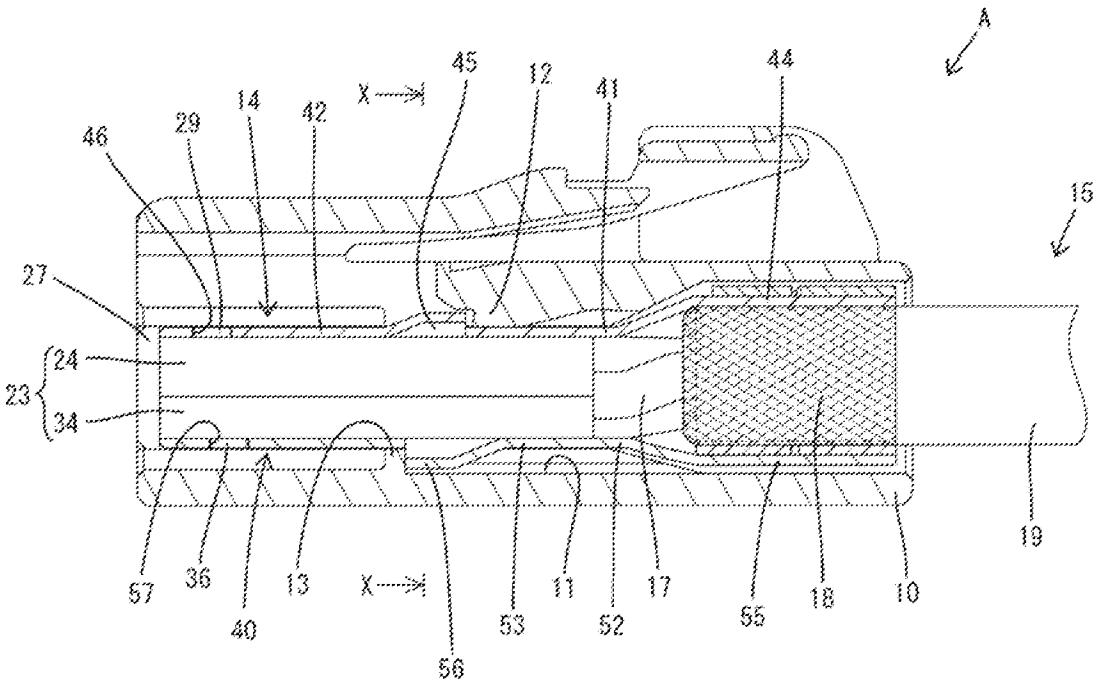
FIG. 2 is a side view in section of the shield connector.
Figure 3:
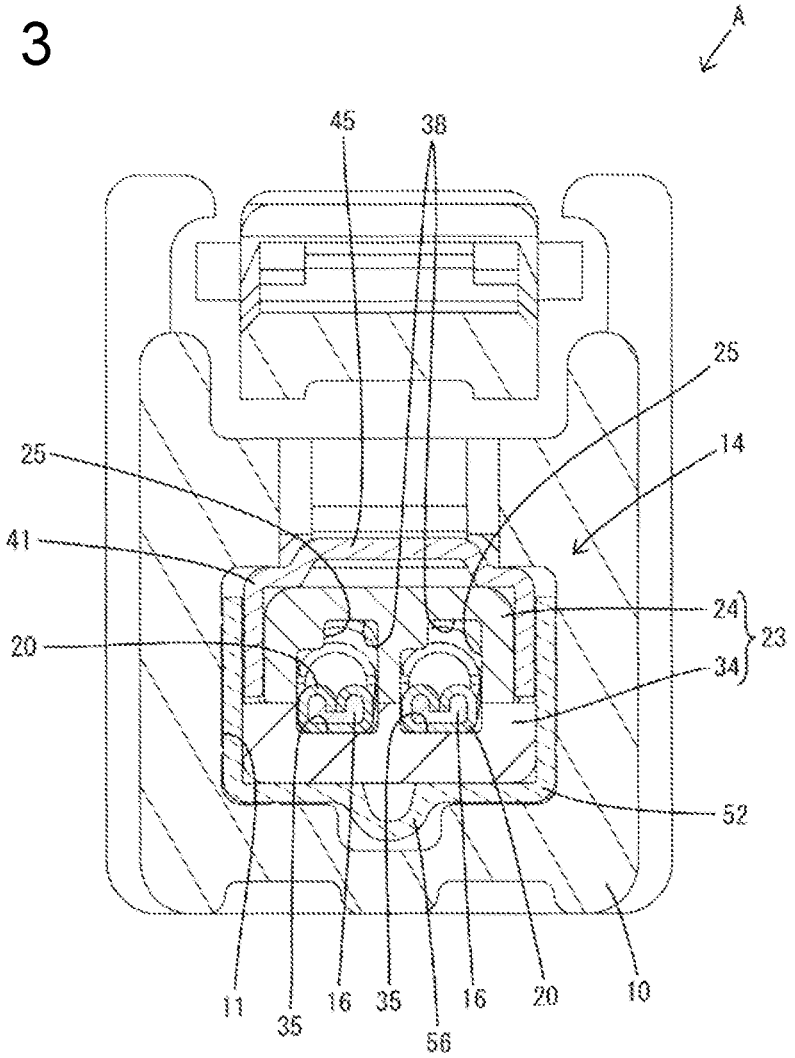
FIG. 3 is a section along X-X of FIG. 2.
Figure 4:
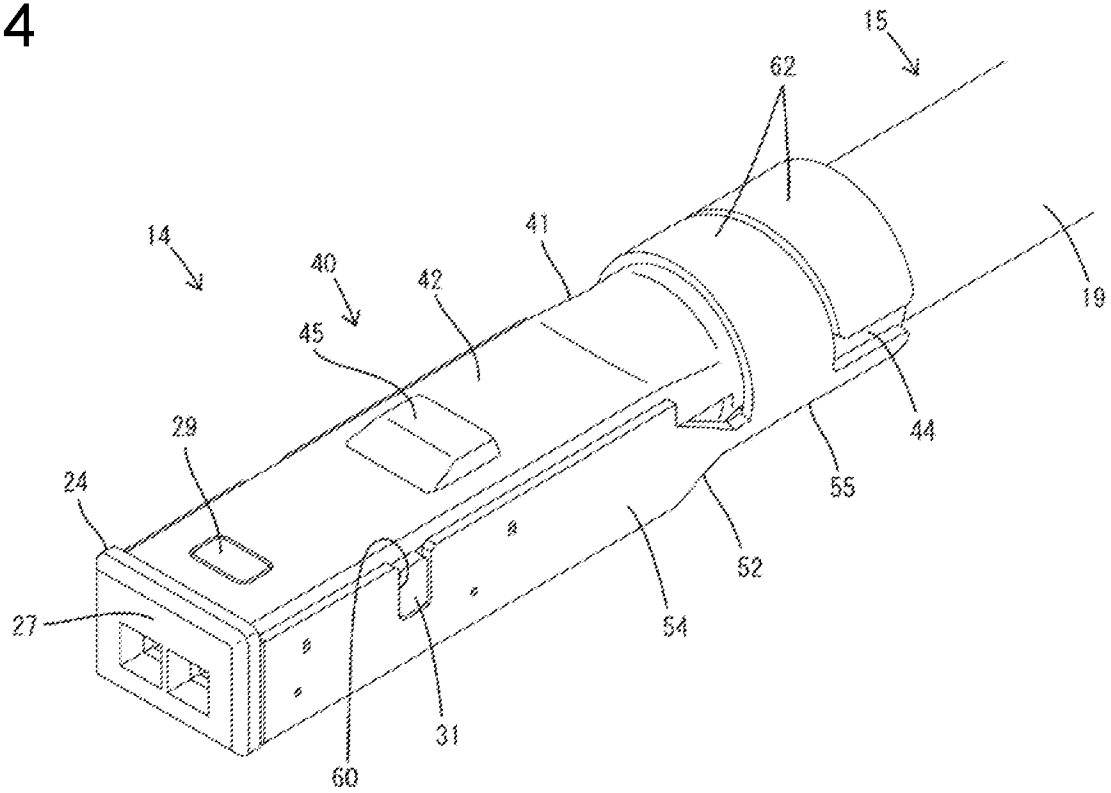
FIG. 4 is a perspective view of an end module.

A specific embodiment of the invention is described with reference to FIGS. 1 to 13. In the following description, a left lower side in FIGS. 1, 4 to 10, 12 and 13 and a left side in FIGS. 2, 3 and 11 are defined as a front concerning a front-rear direction. Upper and lower sides shown in FIGS. 1 to 13 are directly defined as upper and lower sides concerning a vertical direction. Left and right sides shown in FIG. 3 are defined as left and right sides concerning a lateral direction.

A shield connector A of this embodiment is used, for example, in an automatic drive control system of an automotive vehicle, and is a connector having a shielding function and miniaturized. The shield connector A includes an outer housing 10 and an end module 14 (see FIGS. 2 to 5) to be inserted into the outer housing 10. The end module 14 is mounted on a front end part of a shielded cable 15 and includes two terminal fittings 20, a dielectric 23 and an outer conductor 40 (metal member as claimed).

The outer housing 10 is made of synthetic resin. As shown in FIGS. 2 and 3, an accommodation space 11 for accommodating the end module 14 is formed inside the outer housing 10. The accommodation space 11 penetrates through the outer housing 10 in the front-rear direction. A resilient retaining piece 12 cantilevered forward along an upper surface in the accommodation space 11. The resilient retaining piece 12 is resiliently deflectable in the vertical direction (direction intersecting an inserting direction of the end module 14 into the accommodation space 11). Likewise, a stopper 13 projects up from a lower surface in the accommodation space 11.

Figure 6:
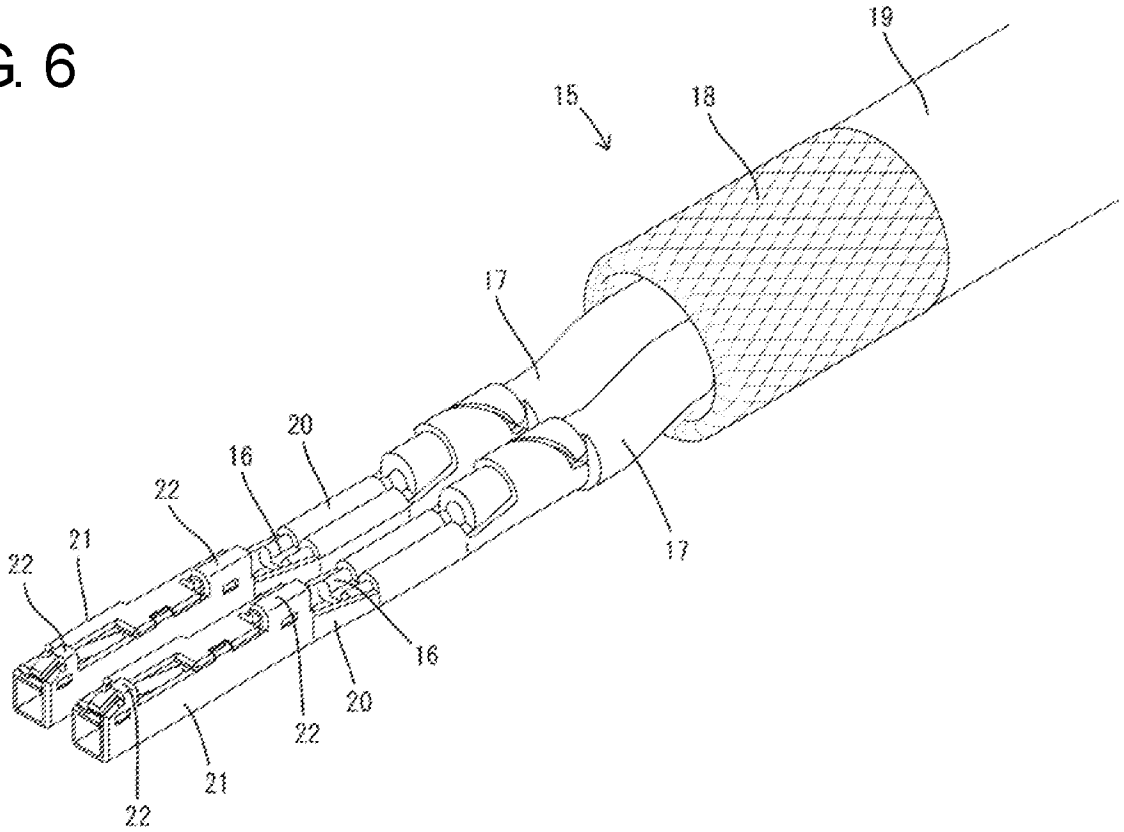
FIG. 6 is a perspective view of a shielded cable.

As shown in FIGS. 6 and 11, the shielded cable 15 includes two cores 16 formed of two coated wires. Inner insulation coatings 17 individually surround the two cores 16, and a braided wire 18 (shield layer as claimed) collectively surrounds the two cores 16 surrounded by the inner insulation coatings 17. A hollow cylindrical synthetic resin sheath 19 surrounds the braided wire 18. The braided wire 18 has a function of electromagnetically shielding the cores 16 by surrounding the cores 16. The two cores 16 are twisted to constitute a twisted pair cable in an internal space of the sheath 19. At a front end part of the shielded cable 15, the two cores 16 are untwisted and exposed substantially in parallel from the tip of the sheath 19. Likewise at the front end part of the shielded cable 15, the braided wire 18 exposed by removing the sheath 19 is folded rearward to cover the outer periphery of a front end part of the sheath 19.

As shown in FIG. 6, the terminal fitting 20 is long and narrow in the front-rear direction and has a rear end conductively crimped to each of front end parts of the two cores 16. A front end region of the terminal fitting 20 defines a rectangular tubular terminal body 21 and two positioning protrusions 22 project up on front and rear end parts of the terminal body 21.

The dielectric 23 is made of synthetic resin and is long and narrow in the front-rear direction. The dielectric 23 is constituted by uniting an upper case 24 shown in FIG. 7 and a lower case 34 shown in FIG. 12. The upper and lower cases 24 and 34 are united in the vertical direction (i.e. direction intersecting the front-rear direction).

Figure 9:
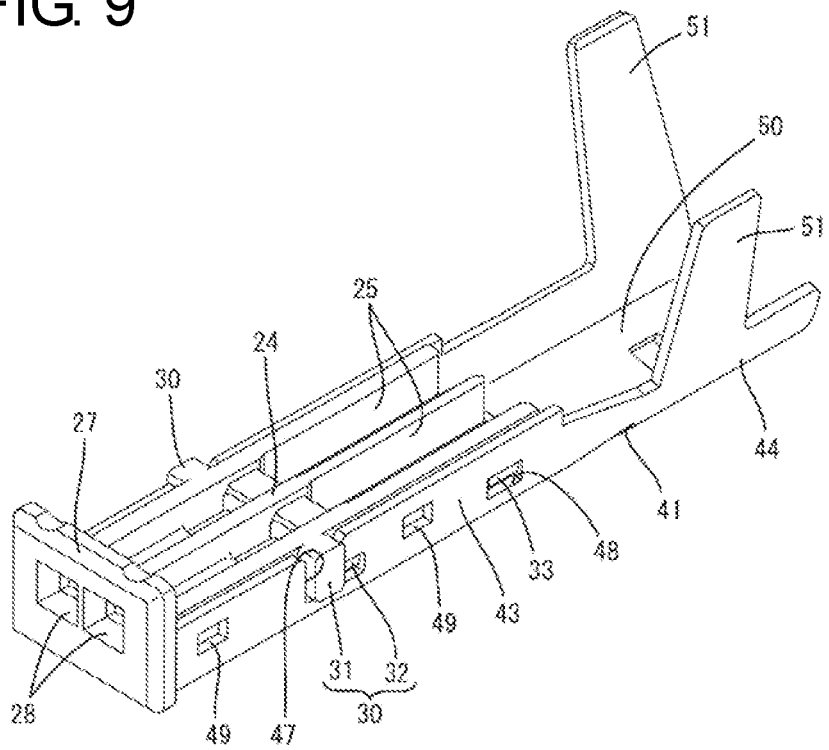
FIG. 9 is a perspective view showing a state where the first shell (upper shell) and the one half body (upper case) are assembled and vertically inverted.

The upper case 24 is formed with left and right accommodation recesses 25 by recessing the lower surface thereof. The accommodation recesses 25 are long and narrow in the front-rear direction and are formed over the entire length of the upper case 24. As shown in FIGS. 9 and 11, front and rear positioning recesses 26 are formed in the accommodation recess 25 by recessing the upper surface of the accommodation recess 25. A substantially upper half of the terminal fitting 20 is accommodated in the accommodation recess 25.

A front wall 27 projects down on a front part of the upper case 24. The front wall 27 is formed with left and right tab insertion openings 28. Each tab insertion opening 28 is disposed to face the front end of the terminal body 21 of the terminal fitting 20 fit into the accommodation recess 25. A tab (not shown) of a mating terminal provided in a mating connector (not shown) is inserted into the terminal body 21 of the terminal fitting 20 through the tab insertion opening 28.

Figure 7:
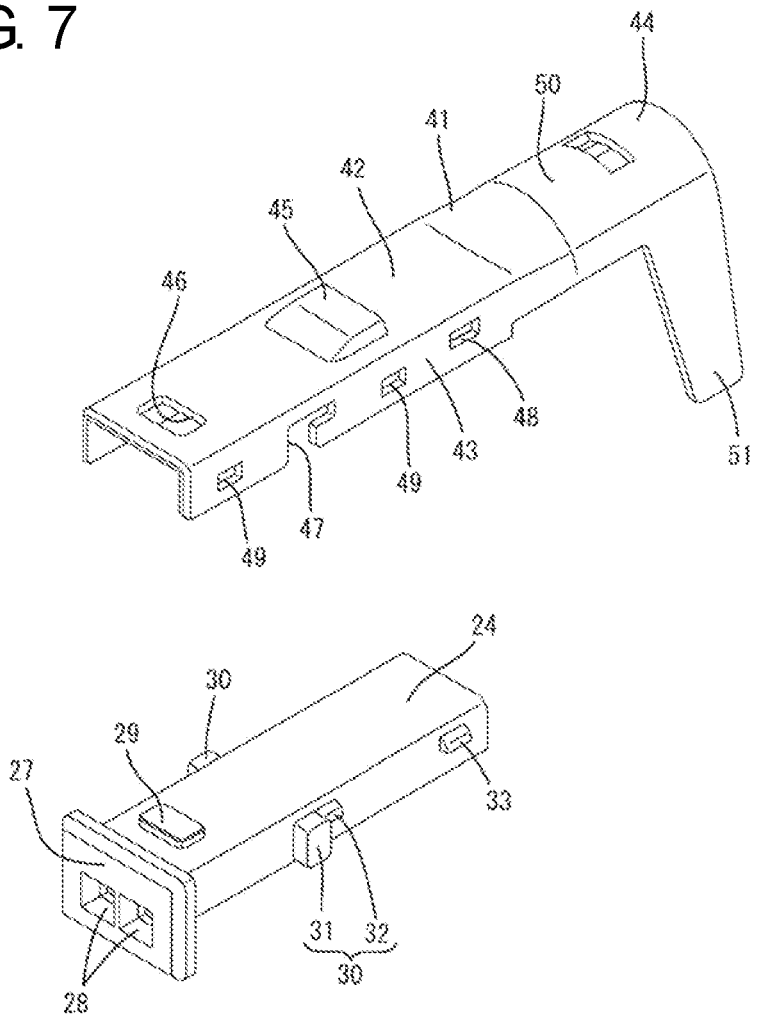
FIG. 7 is a perspective view showing a state where a first shell (upper shell) and one half body (upper case) are divided.

As shown in FIG. 7, an upper surface projection 29 (positioning locking portion as claimed) is formed on the upper surface of the upper case 24. The upper surface projection 29 is disposed on the front end part of the upper case 24. Bilaterally symmetrical first side surface projections 30 (positioning locking portion as claimed) are formed on left and right outer side surfaces of the upper case 24. The first side surface projections 30 are disposed substantially in a central part of the upper case 24 in the front-rear direction. Each first side surface projection 30 is composed of a main projection 31 and an auxiliary projection 32. The auxiliary projection 32 has a smaller projecting dimension than the main projection 31 and has a smaller vertical dimension than the main projection 31. The auxiliary projection 32 projects rearward from the rear surface of an upper end part of the main projection 31. Bilaterally symmetrical second side surface projections 33 (positioning locking portion as claimed) are formed on the both left and right outer side surfaces of the upper case 24. The second side surface projections 33 are disposed on a rear part (positions behind the first side surface projections 30) of the upper case 24.

Figure 12:
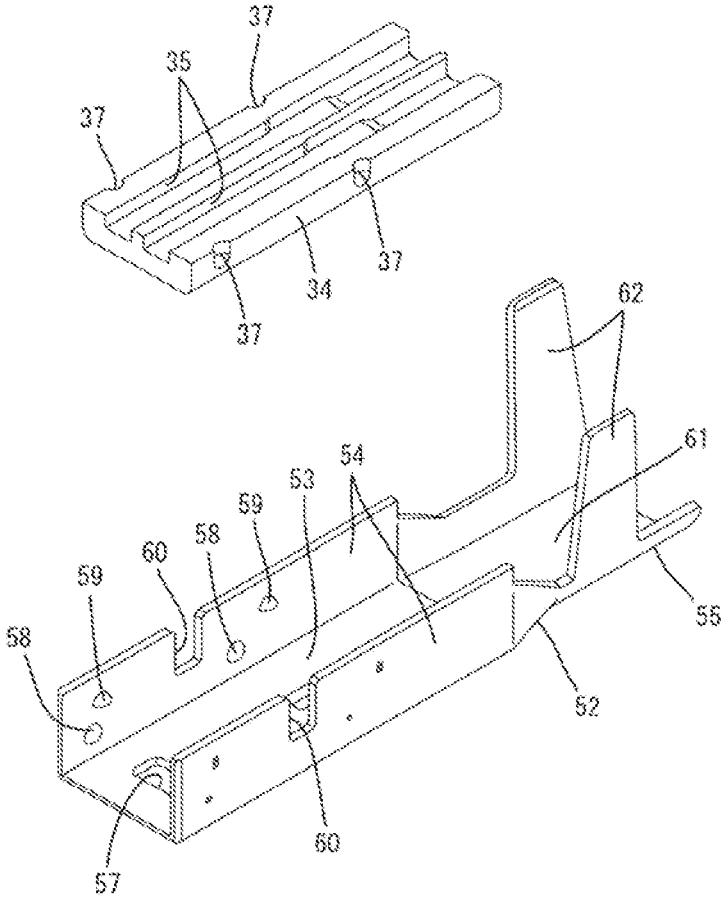
FIG. 12 is a perspective view showing a state where a second shell (lower shell) and the other half body (lower case) are divided.

As shown in FIG. 12, the upper surface of the lower case 34 is formed with left and right accommodation grooves 35. The accommodation grooves 35 are long and narrow in the front-rear direction and are formed over the entire length of the lower case 34. As shown in FIG. 3, a substantially lower half of the terminal fitting 20 is accommodated in each accommodation groove 35. The terminal fitting 20 accommodated in the accommodation groove 35 is sandwiched by inner side surfaces of the accommodation groove 35 to restrict relative displacements in the lateral direction with respect to the lower case 34.

Figure 5:
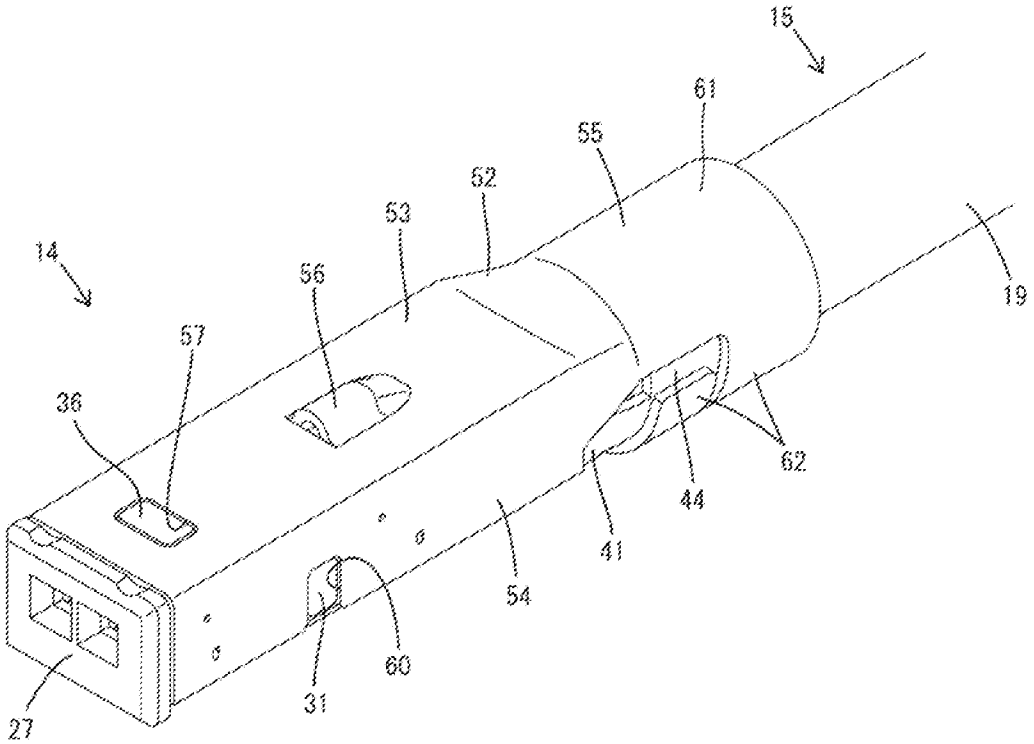
FIG. 5 is a perspective view showing a state where the end module is vertically inverted.

As shown in FIG. 5, a lower surface projection 36 (positioning locking portion as claimed) is formed on the lower surface of the lower case 34. The lower surface projection 36 is disposed on a front end part of the lower case 34. Two pairs of bilaterally symmetrical side surface recesses 37 (positioning locking portion as claimed) are formed in left and right outer side surfaces of the lower case 34. The side surface recesses 37 are disposed in the front end part of the lower case 34 and a substantially central part of the lower case 34 in the front-rear direction.

The upper case 24 and the lower case 34 are united to form the dielectric 23 so that the accommodation recesses 25 and the accommodation grooves 35 vertically face each other. As shown in FIG. 3, the accommodation recesses 25 and the accommodation grooves 35 form left and right terminal accommodation chambers 38 inside the dielectric 23 when the cases 23 and 24 are united. The upper case 24 and the lower case 34 are not formed with parts to be directly locked and fit to each other. Thus, the dielectric 23 does not have a function of holding the cases 24, 34 together and the cases 24, 34 are held united via the outer conductor 40 described later.

The outer conductor 40 is formed into a substantially rectangular tube long in the front-rear direction by applying bending and the like to a metal plate material of a predetermined shape and has a function of electromagnetically shielding the terminal fittings 20 and the front parts of the cores 16 by surrounding the terminal fittings 20 and the front parts of the cores 16. The outer conductor 40 is configured by uniting an upper shell 41 shown in FIG. 7 and a lower shell 52 shown in FIG. 12. The upper shell 41 and the lower shell 52 are united in the vertical direction (i.e. direction intersecting the front-rear direction), similar to the dielectric 23.

The upper shell 41 includes an upper surface plate 42, two bilaterally symmetrical inner side surface plates 43 extending down from both left and right side edges of the upper surface plate 42 and an upper-side crimping portion 44. The upper surface plate 42 is formed with a retaining projection 45 projecting up (out). The retaining projection 45 is disposed substantially in a central part of the upper surface plate 42 in the front-rear direction. An upper surface locking portion 46 penetrates a front part of the upper surface plate 42 in a plate thickness direction (vertical direction).

Two bilaterally symmetrical first side surface locking portions 47 are formed in the left and right inner side surface plates 43. The first side surface locking portion 47 is at a position slightly before a substantially central part of the inner side surface plate 43 in the front-rear direction. The first side surface locking portion 47 penetrates through the inner side surface plate 43 in the lateral direction and is open in the lower end edge of the inner side surface plate 43. An opening of the first side surface locking portion 47 is shaped such that the entire first side surface projection 30 can fit therein. Two bilaterally symmetrical second side surface locking portions 48 are formed in the left and right inner side surface plates 43. The second side surface locking portion 48 is disposed in a rear end part of the inner side surface plate 43. The second side surface locking portion 48 penetrates through the inner side surface plate 43 in a plate thickness direction (lateral direction). An opening of the second side surface locking portion 48 is shaped such that the entire second side surface projection 33 can fit therein.

The left and right inner side surface plates 43 are formed with two pairs of bilaterally symmetrical fitting holes 49 (uniting first locking portion as claimed). The fitting holes 49 are disposed in front end parts of the inner side surface plates 43 and at positions between the first and second side surface locking portions 47 and 48 in the inner side surface plates 43. The fitting holes 49 penetrate through the inner side surface plates 43 in the plate thickness direction (lateral direction).

The upper-side crimping portion 44 extends rearward from the rear end of the upper surface plate 42. The upper-side crimping portion 44 is in the form of an open barrel including an upper-side base plate 50 connected to the upper surface plate 42 and two upper-side caulking pieces 51 extending down from both left and right side edges of the upper-side base plate 50. The upper-side caulking pieces 51 are disposed at positions displaced from each other in the front-rear direction. The upper-side crimping portion 44 is crimped to the outer periphery of the braided wire 18. The braided wire 18 is sandwiched over the entire circumference between the outer periphery of the sheath 19 of the shielded cable 15 and the upper-side crimping portion 44 and conductively connected to the upper shell 41 (outer conductor 40).

The lower shell 52 includes a lower surface plate 53, two bilaterally symmetrical outer side surface plates 54 extending up from both left and right side edges of the lower surface plate 53 and a lower-side crimping portion 55. The lower surface plate 53 is formed with a front stop 56 projecting down (out). The front stop 56 is disposed substantially in a central part of the lower surface plate 53 in the front-rear direction. A lower surface locking portion 57 penetrates a front part of the lower surface plate 53 in a plate thickness direction (vertical direction).

Two pairs of bilaterally symmetrical first side surface protrusions 58 are formed on the left and right outer side surface plate portions 54. The side surface protrusions 58 are disposed on a front part of the outer side surface plate 54 and in a central part of the outer side surface plate 54 in the front-rear direction. The side surface protrusions 58 are formed by striking the outer side surface plate 54 inward. Likewise, two pairs of bilaterally symmetrical fitting projections 59 (uniting second locking portion as claimed) are formed on the left and right outer side surface plates 54. The fitting projections 59 are disposed on the front part of the outer side surface plate 54 and in the central part of the outer side surface plate 54 in the front-rear direction. The side surface protrusions 58 are at positions closer to the lower surface plate 53 than the fitting projections 59. Similar to the side surface protrusions 58, the fitting projections 59 are formed by striking the outer side surface plate 54 inward.

Two bilaterally symmetrical positioning cuts 60 are formed in the left and right outer side surface plates 54. Each positioning cut 60 penetrates the outer side surface plate 54 in a plate thickness direction (lateral direction) and is open in the upper end edge of the outer side surface plate 54. An opening of the positioning cut 60 is shaped to be fit only to the main projection 31 of the first side surface projection 30 of the upper case 24.

The lower-side crimping portion 55 extends rearward from the rear end of the lower surface plate 53. The lower-side crimping portion 55 is in the form of an open barrel including a lower-side base plate 61 connected to the lower surface plate 53 and two lower-side caulking pieces 62 extending up from left and right side edges of the lower-side base plate 61. The lower-side caulking pieces 62 are at positions displaced from each other in the front-rear direction. The lower-side crimping portion 55 is crimped to the outer periphery of the upper-side crimping portion 44. In a crimped state, the lower-side base plate 61 is in close contact with the outer peripheral surfaces of the upper-side caulking pieces 51 and the lower-side caulking pieces 62 are in close contact with the outer peripheral surface of the upper-side base plate 50.

Figure 8:
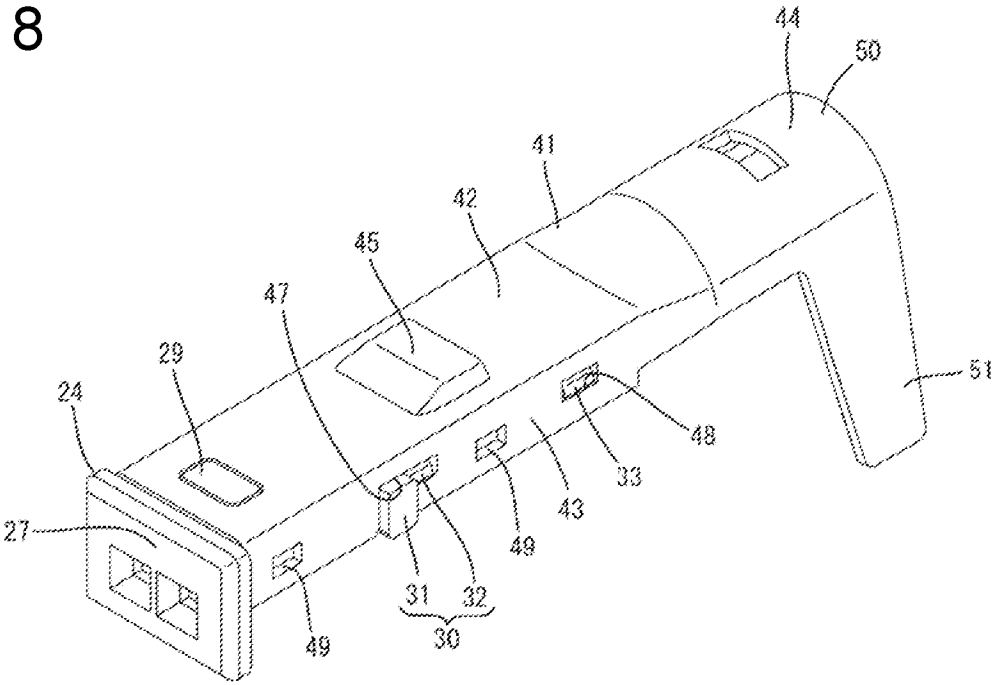
FIG. 8 is a perspective view showing a state where the first shell (upper shell) and the one half body (upper case) are assembled.

The shield connector A is assembled in the following procedure. First, as shown in FIGS. 8 and 9, the upper case 24 is assembled in the upper shell 41. In an assembled state, the upper case 24 is sandwiched between the left and right inner side surface plates 43 of the upper shell 41 and the upper surface of the upper case 24 is in close contact with or proximately facing the lower surface of the upper surface plate 42 of the upper shell 41. Further, the upper surface projection 29 of the upper case 24 is fit into the upper surface locking portion 46 of the upper shell 41, and the first side surface projections 30 and the second side surface projections 33 of the upper case 24 are fit respectively into the first side surface locking portions 47 and the second side surface locking portions 48 of the upper shell 41. In the above way, the upper case 24 and the upper shell 41 are positioned with relative displacements in the front-rear direction, the lateral direction and the vertical direction restricted and are held in the assembled state.

Figure 10:
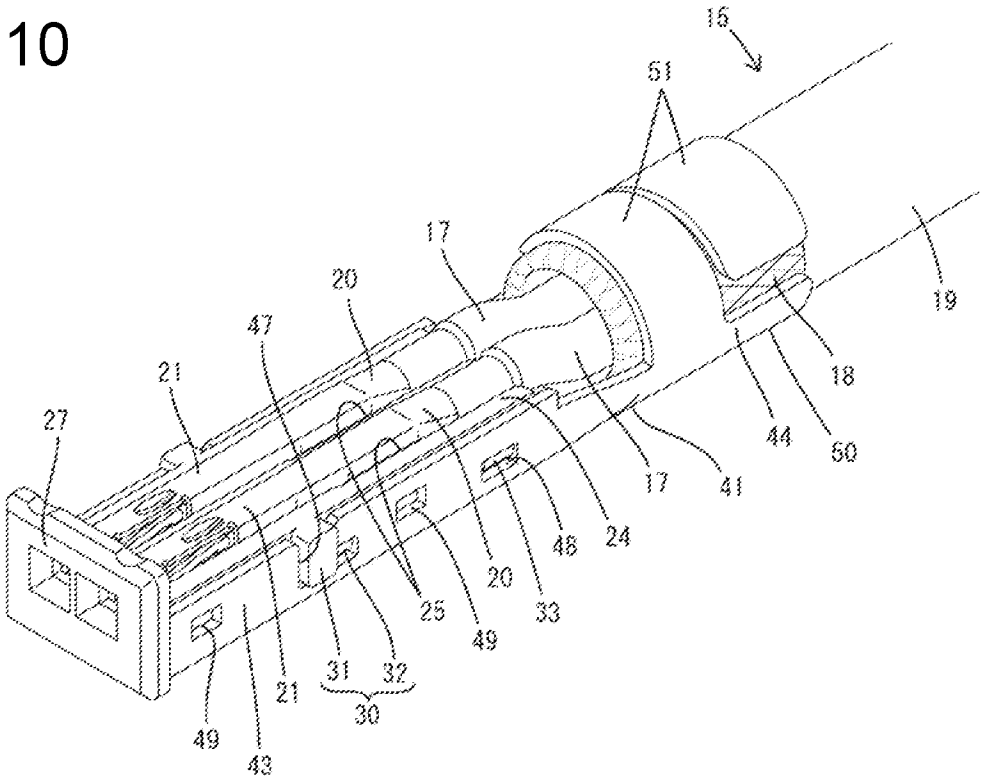
FIG. 10 is a perspective view showing a state where terminal fittings are mounted in the first shell (upper shell) and the one half body (upper case).
Figure 11:
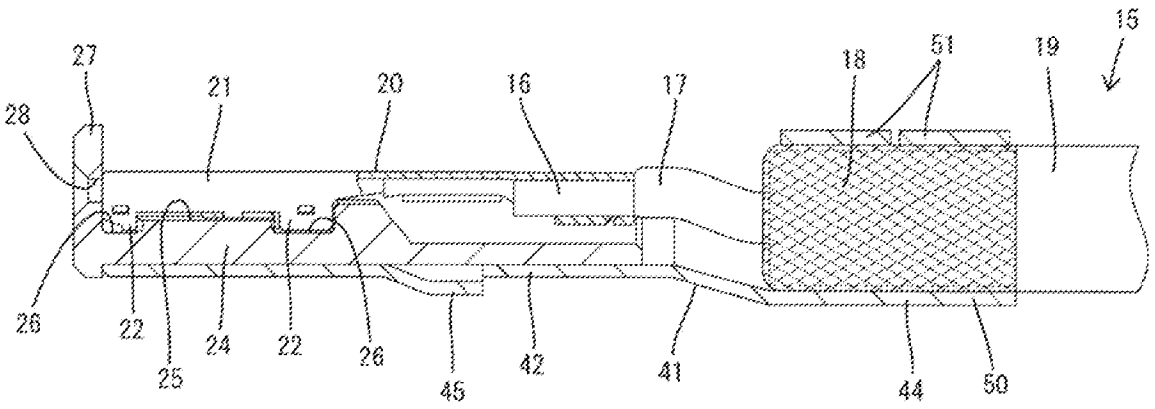
FIG. 11 is a side view in section showing the state where the terminal fittings are mounted in the first shell (upper shell) and the one half body (upper case).

The assembled and integrated upper case 24 and upper shell 41 are vertically inverted, as shown in FIG. 9, and the terminal fittings 20 are accommodated into the accommodation recesses 25 of the upper case 24, as shown in FIG. 10. At this time, the terminal fittings 20 are not displaced in a length direction of the shielded cable 15 from behind the upper case 24, but are caused to drop into the accommodation recesses 25 from above the upper case 24. A displacing direction of the terminal fittings 20 at this time is a direction intersecting the front-rear direction in which the terminal fittings 20 and the end part of the shielded cable 15 are arranged.

The terminal fittings 20 accommodated into the accommodation recesses 25 are sandwiched by the inner side surfaces of the accommodation recesses 25 and positioned with respect to the upper case 24 with relative displacements in the lateral direction restricted, as shown in FIGS. 3 and 10. Further, as shown in FIG. 11, the terminal fittings 20 accommodated in the accommodation recesses 25 are positioned with respect to the upper case 24 with relative displacements in the front-rear direction restricted by fitting the positioning protrusions 22 into the positioning recesses 26. In the above way, the terminal fittings 20 are eld temporarily in the upper case 24 and the upper shell 41.

After the terminal fittings 20 are accommodated into the upper case 24, the upper-side crimping portion 44 is crimped to the outer periphery of the braided wire 18. At this time, the upper-side caulking pieces 51 are caulked to be wound around the outer periphery of the braided wire 18. The upper shell 41 is integrated with the sheath 19 of the shielded cable 15 to restrict relative displacements of the upper case 24 assembled with the upper shell 41 and the terminal fittings 20 positioned and accommodated in the upper case 24 in the front-rear direction, the lateral direction and the vertical direction.

Figure 13:
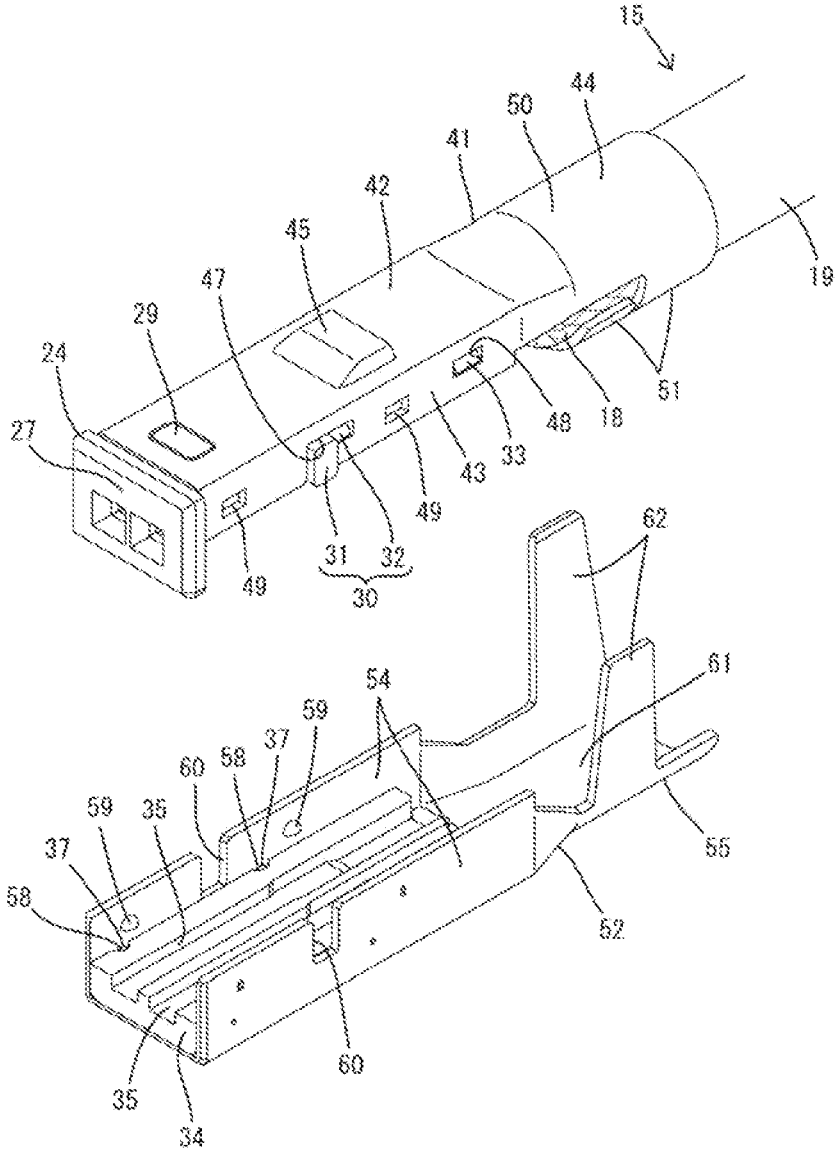
FIG. 13 is a perspective view showing a state where the one half body (upper case) mounted with the terminal fitting and the first shell (upper shell) and the other half body (lower case) mounted with the second shell (lower shell) are divided.

Simultaneously with or before or after a step of assembling the upper case 24 and the upper shell 41, as described above, a step of assembling the lower case 34 and the lower shell 52 is performed, as shown in FIG. 13. In the assembled state, the lower case 34 is sandwiched between the left and right outer side surface plates 54 of the lower shell 52 and the lower surface of the lower case 34 is in close contact with or proximately facing the upper surface of the lower surface plate 53 of the lower shell 52. Further, the lower surface projection 36 of the lower case 34 is fit into the lower surface locking portion 57 of the lower shell 52 and the side surface recesses 37 of the lower case 34 are fit to the side surface protrusions 58 of the lower shell 52. In this way, the lower case 34 and the lower shell 52 are positioned and held in the assembled state with relative displacements in the front-rear direction, the lateral direction and the vertical direction restricted.

The vertically inverted upper case 24 and upper shell 41 are united with the assembled and integrated lower case 34 and lower shell 52 from above to sandwich the terminal fittings 20. When they are united, the accommodation grooves 35 of the lower case 34 are fit to the terminal fittings 20, the dielectric 23 is constituted by the upper and lower cases 24 and 34 and, simultaneously, the outer conductor 40 is constituted by the upper shell 41 and the lower shell 52. Two left and right terminal accommodation chambers 38 are formed by the accommodation recesses 25 and the accommodation grooves 35 in the dielectric 23, and the terminal fittings 20 are positioned (i.e. in a state where separation of the dielectric 23 to outside is restricted) and accommodated in the terminal accommodation chambers 38.

With the upper shell 41 and the lower shell 52 united, the fitting projections 59 of the lower shell 52 are fit into the fitting holes 49 of the upper shell 41 and the main projections 31 of the first side surface projections 30 of the upper case 24 are fit into the positioning cuts 60 of the lower shell 52. By the fitting of these, the upper shell 41 and the lower shell 52 are positioned and held with relative displacements in the front-rear direction, the lateral direction and the vertical direction restricted.

If the upper shell 41 and the lower shell 52 are united, the upper case 24 assembled with the upper shell 41 and the lower case 34 assembled with the lower shell 52 are positioned and held together via the outer conductor 40. Thereafter, the lower-side crimping portion 55 is crimped to the outer periphery of the upper-side crimping portion 44. Since the lower shell 52 is integrated with the upper shell 41 and the shielded cable 15 in this way, relative displacements of the lower case 34 in the front-rear direction, the lateral direction and the vertical direction also are restricted with respect to the sheath 19 of the shielded cable 15. In the above way, the end module 14 is configured.

The completely assembled end module 14 is inserted into the accommodation space 11 from behind the outer housing 10. In an inserting process, the resilient retaining piece 12 interferes with the front wall 27 of the upper case 24 and the upper shell 41, thereby being resiliently displaced upward. When the end module 14 reaches a proper insertion position, the front stop 56 butts against the stopper 13 to restrict further insertion of the end module 14. Simultaneously, the resilient retaining piece 12 resiliently returns and is locked to the retaining projection 45 from behind, and the end module 14 is retained by this locking.

The shield connector A of this embodiment includes the terminal fittings 20 connected to the cores 16 of the shielded cable 15, the dielectric 23 and the outer housing 10. The dielectric 23 is made of synthetic resin and accommodates the terminal fittings 20 positioned in three-dimensional directions. The dielectric 23 is composed of two half bodies (upper case 24 and lower case 34). The upper case 24 and the lower case 34 constitute the dielectric 23 by being united to sandwich the terminal fittings 20. The upper case 24 and the lower case 34 can be divided and united in the vertical direction intersecting the front-rear direction in which the terminal fittings 20 and the cores 16 connected to the terminal fittings 20 are arranged. The outer conductor 40 and the dielectric 23 are accommodated in the outer housing 10.

According to this shield connector A, the terminal fittings 20 are positioned in the dielectric 23 by being sandwiched between the upper case 24 and the lower case 34. The terminal fittings 20 are positioned by a non-resilient locking structure realized by the positioning recesses 26. Thus, a resiliently deformable retaining means such as a locking lance need not be formed inside the dielectric 23. In this way, the shield connector A of this embodiment can reliably hold the terminal fittings 20 in the dielectric 23 while realizing miniaturization.

Further, the shield connector A includes the outer conductor 40 made of metal, assembled with the dielectric 23 to surround the outer periphery of the dielectric 23 and connected to the braided wire 18 of the shielded cable 15. The upper case 24 and the lower case 34 are formed with positioning locking portions (upper surface projection 29, first side surface projections 30, second side surface projections 33, lower surface projection 36, side surface recesses 37) for positioning the upper case 24 and the lower case 34 in the united state by being locked to the outer conductor 40. According to this configuration, the upper case 24 and the lower case 34 are not locked directly to each other, but are united via the outer conductor 40 made of metal having higher rigidity than synthetic resin. In this way, the upper case 24 and the lower case 34 made of synthetic resin need not be formed with resiliently deflectable locking parts so that miniaturization of the dielectric 23 can be achieved.

Further, the outer conductor 40 is configured by uniting the upper shell 41 and the lower shell 52. The upper shell 41 is assembled with the upper case 24 to cover the outer surface of the upper case 24 in a state where the upper case 24 and the lower case 34 are divided. The lower shell 52 is assembled with the lower case 34 to cover the outer surface of the lower case 34 in the state where the upper case 24 and the lower case 34 are divided. The upper shell 41 is formed with uniting first locking portions (fitting holes 49) and the lower shell 52 is formed with uniting second locking portions (fitting projections 59). By locking the uniting first locking portions and the uniting second locking portions to each other, the upper shell 41 and the lower shell 52 are held together to constitute the outer conductor 40.

According to this configuration, if the upper case 24 and the upper shell 41 are assembled and the lower case 34 and the lower shell 52 are assembled, the upper case 24 and the lower case 34 can be held together and the terminal fittings 20 can be accommodated in the dielectric 23 by uniting the upper and lower shells 41 and 52. Thus, when the upper case 24 and the lower case 34 are united while sandwiching the terminal fittings 20, a worker need not hold the upper case 24 and the lower case 34 together by hand. In this way, work efficiency is improved.

Further, the outer conductor 40 is formed with the upper-side crimping portion 44 to be crimped to the outer periphery of the sheath 19 of the shielded cable 15 while being held in contact with the braided wire 18. If the upper-side crimping portion 44 is crimped to the sheath 19, relative displacements of the terminal fittings 20 and the dielectric 23 with respect to the sheath 19 are restricted by the outer conductor 40 made of metal. Thus, there is no risk of bending or deforming parts of the cores 16 exposed from the front end of the sheath 19. Since this prevents the end module 14 from shaking when the end module 14 is accommodated into the outer housing 10 by gripping the outer periphery of the shielded cable 15, work efficiency is good.

The invention is not limited to the above described and illustrated embodiment. For example, the following embodiments also are included in the scope of the invention.

Although the cores of the shielded cable constitute a twisted pair cable in the above embodiment, the cores may be arranged in parallel inside the sheath.

The shielded cable has two cores surrounded by one shield layer in the above embodiment. However, the shielded cable may have each core is surrounded by an individual shield layer.

The shielded cable is such that the cores are surrounded individually by the inner insulation coatings in the above embodiment. However, the two cores may be surrounded collectively by one inner insulation coating.

Although two terminal fittings are accommodated in one dielectric in the above embodiment, one, three or more terminal fittings may be accommodated in one dielectric.

The half bodies (upper case and lower case) are held together via the outer conductor in the above embodiment. However, the half bodies may be locked directly to each other.

Although the outer conductor unites the upper shell and lower shell in the above embodiment, the outer conductor may be a single component.

The shield layer and the outer conductor are connected by sandwiching the shield layer (braided wire) between the outer periphery of the sheath of the shielded cable and the crimping portion (upper-side crimping portion) in the above embodiment. However, the shield layer and the outer conductor may be connected by firmly fixing the shield layer to the outer periphery of the outer conductor.

The shield layer (braided wire) is sandwiched between the outer periphery of the sheath of the shielded cable and the crimping portion (upper-side crimping portion) of the first shell (upper shell) in the above embodiment. However, the shield layer may be sandwiched between the crimping portion (upper-side crimping portion) of the first shell (upper shell) and the crimping portion (lower-side crimping portion) of the second shell (lower shell).

Although both the first shell (upper shell) and the second shell (lower shell) are crimped to the outer periphery of the shielded cable in the above embodiment, only one of the first and second shells may be crimped to the outer periphery of the shielded cable.

Although the shield layer is the braided wire in the above embodiment, the shield layer may be a metal foil or the like.

Although the cable is the shielded cable including the shield layer in the above embodiment, the invention can be applied also when the cable is a non-shielded cable including no shield layer. In this case, the outer conductor surrounding the dielectric may not be provided.

Although application to the shield connector including the outer conductor is described in the above embodiment, the invention can be also applied to non-shield type connectors including no outer conductor.

Although the dielectric and the outer conductor are accommodated in the outer housing in the above embodiment, the dielectric and/or the outer conductor may not be accommodated in the outer housing.

A metal member that positions the half bodies together is used as the outer conductor having the shielding function in the above embodiment. However, the outer conductor may be provided separately from the metal member for positioning the half bodies in the united state.

LIST OF REFERENCE SIGNS

A . . . shield connector
10 . . . outer housing
15 . . . shielded cable
16 . . . core
18 . . . braided wire (shield layer)
20 . . . terminal fitting
23 . . . dielectric
24 . . . upper case
29 . . . upper surface projection (positioning locking portion)
30 . . . first side surface projection (positioning locking portion)
33 . . . second side surface projection (positioning locking portion)
34 . . . lower case
36 . . . lower surface projection (positioning locking portion)
37 . . . side surface recess (positioning locking portion)
40 . . . outer conductor
41 . . . upper shell (first shell)
44 . . . upper-side crimping portion
49 . . . fitting hole (uniting first locking portion)
52 . . . lower shell (second shell)
55 . . . lower-side crimping portion
59 . . . fitting projection (uniting second locking portion)

The invention claimed is:

1. A connector, comprising:

a terminal fitting to be connected to a core of a cable;

a dielectric made of synthetic resin and formed from first and second half bodies that are configured to be united with one another and completely divided from one another in a direction intersecting an arrangement direction of the terminal fitting and the core connected to the terminal fitting, the first and second half bodies that are united being configured to sandwich the terminal fitting in a positioned state; and a metal member that includes first and second shells assembled respectively with the first and second half bodies to cover outer surfaces of the respective first and second half bodies in a state where the half bodies are divided, the first and second shells being formed respectively with uniting first and second locking portions, wherein the first shell and the second shell are held together by locking the uniting first locking portion and the uniting second locking portion to each other and thereby hold the first and second half bodies united with one another.

2. The connector of claim 1, further comprising:

positioning locking portions formed on the half bodies and configured to position the half bodies together by being locked to the metal member.

3. The connector of claim 2, wherein the metal member includes a crimping portion configured to be crimped to an outer periphery of the cable.

4. The connector of claim 3, wherein:

the cable includes a shield layer configured to electromagnetically shield the core by surrounding the core; and the metal member is an outer conductor surrounding the dielectric while being connected to the shield layer.

5. The connector of claim 1, wherein the metal member includes a crimping portion configured to be crimped to an outer periphery of the cable.

6. The connector of claim 1, wherein:

the cable includes a shield layer configured to electromagnetically shield the core by surrounding the core; and the metal member is an outer conductor surrounding the dielectric while being connected to the shield layer.

7. The connector of claim 1, wherein each of the first and second half bodies has a front end and a rear end opposite front end, the front ends of the half bodies being aligned with one another when the first and second half bodies are united, and the rear ends of the half bodies being aligned with one another when the first and second half bodies are united.

8. The connector of claim 7, wherein each of the first and second half bodies has a front wall at the front end thereof, the first shell extending from the front wall of the first half body to a position rearward of the rear end of the first half body, and the second shell extending from the front wall of the second half body to a position rearward of the rear end of the second half body.

9. The connector of claim 7, wherein the rear ends of the half bodies are crimped to the cable at positions rearward of the rear ends of the first and second half bodies.

* * * * *